US005296342A

United States Patent [19]

Roefs et al.

[11] Patent Number: 5,296,342

[45] Date of Patent: Mar. 22, 1994

[54] METHOD OF DEVELOPING X-RAY MATERIALS

[75] Inventors: André Roefs, Herentals; Francis Sels, Kontich; Marc Van den Zegel, Boortmeerbeek, all of Belgium

[73] Assignee: Agfa-Gevaert, N.V., Mortsel, Belgium

[21] Appl. No.: 975,000

[22] Filed: Nov. 12, 1992

[30] Foreign Application Priority Data

Nov. 14, 1991 [EP] European Pat. Off. ..... 91202953.5

[51] Int. Cl.[5] ..... G03C 5/29

[52] U.S. Cl. ..... 430/438; 430/440; 430/447; 430/464; 430/479; 430/481; 430/486

[58] Field of Search ..... 430/363, 434, 435, 436, 430/438, 440, 447, 464, 478, 479, 480, 481, 482, 483, 486, 489

[56] References Cited

U.S. PATENT DOCUMENTS 5,204,230 4/1993 Hayashi ..... 430/450

FOREIGN PATENT DOCUMENTS 2164461 3/1986 United Kingdom ..... 430/489

*Primary Examiner*—Hoa Van Le

*Attorney, Agent, or Firm*—Breiner & Breiner

[57] ABSTRACT

For the processing in a total processing time of 60 seconds or less of exposed X-ray materials containing silver bromide or silver bromoiodide emulsions use is made of an aqueous alkaline photographic developing solution, having a pH in the range of 9 to 12, comprising a dihydroxybenzene developing agent, 4-hydroxymethyl-4-methyl-1-phenyl-3-pyrazolidinone as an auxiliary developing agent, at least one organic antifoggant and a compound providing iodide ions.

9 Claims, No Drawings

METHOD OF DEVELOPING X-RAY MATERIALS

FIELD OF THE INVENTION

This invention relates to the development of medical X-ray films. More specifically, this invention relates to an improved aqueous alkaline photographic developing solution that is especially adapted for the use in the development of X-ray films.

BACKGROUND OF THE INVENTION

Heretofore, developing solutions for use with X-ray film have typically been formulated using hydroquinone as the primary developing agent, 1-phenyl-3-pyrazolidinone as a super-additive auxiliary developing agent and glutaric aldehyd as a hardening agent. These developing solutions have been packaged as three-part formulations. The need for the added cost and complexity of three-part packaging has been dictated by the fact that glutaric aldehyd tends to react with 1-phenyl-3-pyrazolidinone, that 1-phenyl-3-pyrazolidinone tends to oxidize in alkaline solution and that glutaric aldehyde tends to polymerize in alkaline solution. To avoid these problems, the hydroquinone has been packaged in a first part which is alkaline, the 1-phenyl-3-pyrazolidinone has been packaged in a second part which is acidic and the glutaric aldehyd has been packaged in a third part which is acidic. Prior to use the three parts are blended together and diluted with water to give the appropriate concentration and alkaline pH for use as working developing solution.

These developing solutions are used in the standard 90 seconds processing of commercial medical X-ray materials having a film support and on one or both sides thereof silver bromide or silver bromoiodide emulsion layers.

There is a tendency of further decreasing the total processing time of X-ray materials in particular to less than 60 seconds e.g. 45 seconds processing and even 38 seconds processing. The requirement is that the sensitometry obtained with such short processing times should match the sensitometry of conventional radiographic materials now processed in 90 seconds as referred to above.

Decreasing processing time is possible when using X-ray materials that have been adequately fore-hardened so that they absorb less water and lend themselves to accelerated processing and drying. However increasing the level of fore-hardening usually results in a decrease of the covering power so that not all materials can be adequately fore-hardened. Tabular grain emulsions lend themselves to increased levels of fore-hardening because they are less sensitive to a decrease in covering power.

In EP Application 428,455 the accelerated processing of forehardened X-ray films has been described leading to sensitometric results comparable to those obtained with standard 90 seconds processing with aldehyde contai-ning developers of conventional X-ray materials. In said EP Application 428,455 fore-hardened X-ray films are developed with a developing solution having a pH in the range of 9 to 12, being substantially free of both aldehydic hardening agents and silver halide solvents and comprising dihydroxybenzene developing agent, a superadditive developing agent, an alkaline agent, an organic anti-foggant and a preservative, the super-additive auxiliary developing agent being present in a concentration of at least 3.5 grams per liter of said developing solution and being a 4,4'-disubstituted-1-aryl-3-pyrazolidinone in particular 4-methyl-4-hydroxymethyl-1-phenyl-3-pyrazolidinone. The use of the latter auxiliary developing agent in this context is also known from USP 4,957,856.

Although sensitometric responses similar to those achieved with conventional aldehydic developers in very short processing times are claimed, the developing solution becomes quite expensive due to the high amounts of expensive auxiliary developing agents. Moreover although one-part packaging of the developing solution is possible the degree of concentration is limited by the crystallization tendency of the auxiliary developing agent. Where it was possible to concentrate the three-part package for the 90 seconds processing so that for a developing solution ready for use up to three volumes of water could be added to part A, the one-part package of EP Application 428,455 can be concentrated only to a degree that maximum dilution is up to two times.

In rapid processing cycles of less than 90 seconds the aim is to maintain unchanged sensitometric characteristics according to the previous-ly formulated requirements. Losses in sensitivity or gradation can be compensated e.g. by reducing the amount of antifoggant or increasing pH of the developer. As a more alkali containing developer is more sensitive to oxidation phenomena this way should not be followed. This can also be stated for a decrease of the amount of antifogging agent, leading to a tremendous fog increase and a gradation decrease. Looking for a suitable auxiliary developer 1-phenyl-3-pyrazolidinone is not preferred due to its tendency to crystallize into the solution as its solubility is low, due to its insufficient stability so that it decomposes and due to the resulting fog increase that is sensitometrically unacceptable. As another auxiliary developing compound 4-methyl-1-phenyl-3-pyrazolidinone doesn't satisfy either as the preservation stability is rather poor. More substituted compounds are more stable in alkaline solutions but the cost is increasing to unacceptable levels. 4-hydroxymethyl-4-methyl-1-phenyl-3-pyrazolidinone is very effective although the cost remains high.

OBJECT OF THE INVENTION

It is an object of the present invention to provide a developing solution suitable for rapid processing of medical X-ray films, containing silver bromide and silver bromoiodide emulsions, in an overall processing time of 60 seconds or less with sensitometric results matching those with standard 90 seconds processing.

It is another object of the present invention to provide a method of developing a silver bromide or silver bromoiodide material with a hydroquinone/4-hydroxymethyl-1-phenyl-3-pyrazolidinone developing solution with a reduced amount of the said 3-pyrazolidinone thus making the developing solution less expensive.

A further object of the present invention is to provide a one-part package hardener-free concentrate for preparing developing solutions for rapid processing of fore-hardened X-ray materials, in particular X-ray materials with tabular silver halide emulsions as well as three-part package concentrates for preparing hardener containing developing solutions for rapid processing.

Further objects will become apparent from the description hereinafter.

SUMMARY OF THE INVENTION

The above objects are accomplished by using for the processing of exposed silver bromide or silver bromoiodide X-ray materials e.g. in a total processing time of 60 seconds or less an aqueous alkaline photographic developing solution, having a pH in the range of 9 to 12, comprising a dihydroxybenzene developing agent, 4-hydroxymethyl-4-methyl-1-phenyl-3-pyrazolidinone as an auxiliary developing agent, and at least one organic antifoggant characterised in that it further contains a compound providing iodide ions.

DETAILED DESCRIPTION OF THE INVENTION

It has been found that the iodide ions providing compound, which is preferably potassium iodide, can partly replace the 4-hydroxymethyl-4-methyl-1-phenyl-3-pyrazolidinone auxiliary developing agent with maintenance of sensitometric results. With an amount of less than 3.5 g of said auxiliary developing agent it is possible to achieve a very short process time while meeting all sensitometric requirements that are important for X-ray film development provided that a iodide ion releasing compound is present. Obviously by substituting iodide ions for part of the auxiliary developing agent in the developing solution, the cost of the developer can be reduced. Moreover the use in a reduced amount of auxiliary developing agent reduces the tendency of said agent to crystallize, so that a more concentrated one-part developing solution can be offered to the customer. So it is possible e.g. to deliver very concentrated developer solutions, the customer has to dilute "1+3", "1" standing for the volume of concentrated developer solution and "3" for the volume of water, instead of e.g. "1+1.5" indicating that the developer solution is less concentrated, allowing less water to be added to make it ready for use.

Also for three-part formulations it is possible to add the iodide ions providing compound or compounds in an adapted amount to one of the three parts. Preferably said iodide ions providing compounds and the 4-hydroxymethyl-4-hydroxy-1-phenyl-3-pyrazolidinone are added to the alkaline developer part A.

According to this invention the one- or three-part package formulation can be used for rapidly processing silver bromide or silver bromoiodide X-ray films within a total cycle including developing, fixing, rinsing and drying of less than 60 seconds. A developing time of 9.3 (respectively 14) seconds for a 38 (respectively 45) seconds processing cycle can be attained. Even for longer processing times of 90 seconds specific advantages are encountered. A more consumer-friendly low temperature processing is accessible: temperatures lower than 35° C. being allowed instead of the normally used 35° C., is accessible. Economical and environmental advantages are thus offered without loss of sensitometric characteristics.

The developing solution of this invention may be free, or at least substantially free, of aldehydic hardening agents such as glutaric aldehyd. When the developing solution is intended for use with x-ray films that have been adequately fore-hardened the incorporation of hardening agents in the developing solution is not necessary.

The developing solution of this invention is preferably free, or is at least substantially free, of silver halide solvents, such as thiosulphates or thiocyanates, these solvents being detrimental to its performance in development of fore-hardened X-ray films, providing an unacceptable sensitometry.

The dihydroxybenzene developing agents employed in the aqueous alkaline developing solutions of this invention are well known and widely used in photographic processing, hydroquinone being a preferred developing agent of this class. Other useful dihydroxybenzene developing agents have been described in EP Application 428.455. A combination of two or more of these developing agents is also possible.

In addition to the dihydroxybenzene developing agent, the developing solution must include 4-hydroxymethyl-4-methyl-l-phenyl-3-pyrazolidinone functioning as an auxiliary super-additive developing agent.

This compound is well-known from Ciba-Geigy's "Irgaform 1266" trademarked black and white photographic developer, disclosed in April 1986 in its "Product Information Bulletin", where the advantages concerning solubility, storage stability and economised packaging costs in X-ray and graphic arts developer applications are mentioned.

Although it is common knowledge to use iodide ions in black and white developers, as e.g. U.S. Pat. No. 5,037,727 where iodide ions are used in an alkaline activator to control the image tone, the combination with foresaid auxiliary developing agent or agents to meet the desired sensitometric requirements was not described untill now. A preferred iodide ion providing compound is potassium iodide, although other alkaline or alkaline earth metal salts of iodide are principally usable as well as other inorganic or organic compounds providing iodide ions. So it has been proved that the replacement in equimolar amounts of the potassium ion by e.g. trimethylsulphonium-, tetraphenylphosphonium- and/or tetraethylammonium-ions is offering the same sensitometric results.

Suitable alkaline agents which can be included in the developing solution to maintain the desired alkaline pH include hydroxides such as sodium hydroxide, carbonates such as sodium carbonate and borates such as sodium tetraborate.

Problems of fog formation are reduced by adding an effective amount of one or more organic antifoggants to the developer. Particularly suitable are benztriazole antifoggants. Further preferred classes of organic antifoggants include mercapto azoles and mercapto azines. A combination in adjusted amounts of two or more of said organic antifoggants which have been described in detail in EP Application 428,455 is also possible. Besides in conjunction with the use of one or more organic antifoggant inorganic restrainers or antifoggants can be utilized, such as alkali metal bromides, preferably potassium bromide.

As the aqueous alkaline photographic developing solutions of this invention are sensitive to aerial oxidation a sulphite preservative can be added in such an amount as to protect the developing agents against this disadvantageous effect, thereby providing sufficiently good stability characteristics. Useful sulphite preservatives include sulphites, bisulphites, metabisulphites and carbonyl bisulphite adducts present as alkaline metal ion. Alternatives like hydroxylamine and ascorbic acid can be used alone or in combination with one another or with said sulphites.

Additional optional additives include sequestering agents, surfactants and organic solvents. Examples of these ingredients are given in EP Application 428,455.

The aqueous alkaline developing solutions used in accordance with this invention can vary widely with regard to the concentration of the various ingredients included therein. Preferably the dihydroxybenzene developing agent (e.g. hydroquinone) is used in an amount of from about 20 to about 40 grams per liter, the 4-hydroxymethyl-4-methyl-1-phenyl-3-pyrazolidinone is used in an amount of less than 5.0 grams per liter, more preferably in an amount between 1.0 and 3.5 grams per liter, the iodide ion releasing compound (e.g. potassium iodide) is used in an amount to provide at least $4.10^{-5}$ equivalents of ions per liter, more preferably in an amount of $8.10^{-5}$ to $8.10^{-4}$ equivalents per liter, 5-methyl-benzotriazole is used in an amount of about $8.10^{-5}$ to about $8.10^{-4}$ moles per liter and 1-phenyl-5-mercaptotetrazole is used in an amount of about 0 to $3.10^{-4}$ moles. The preservative (e.g. potassium sulphite) is used in an amount of about 20 to 100 grams per liter.

Auxiliary agents present in the developer are sodium tetraborate in an amount of 0 to 25 grams per liter, potassium carbonate in an amount of 5 to 20 grams per liter, potassium bromide in an amount of 1 to 5 grams per liter, diethylene glycol in an amount of 10 to 50 grams per liter, ethyle-nediaminetetraacetic acid (sodium salt) in an amount of 1 to 5 grams per liter.

The pH of the developing solution is in the range from 9 to 12 and more preferably in the range from 9.5 to 11.

The developing process is typically carried out at a temperature of about 25° C. to about 50° C. With the developing solution of this invention, very short developing times, such as 10 seconds or less, are feasable, with total processing times of less than 45 seconds, preferably 38 seconds, being contemplated. A typical 38 seconds cycle has development, fixing rinsing and drying times of 9.3 seconds at 35° C., 6.6 seconds at 35° C., 4.4 seconds at 20° C. and 6.7 seconds at 46° C. respectively, time for film transport to be added to reach 38 seconds altogether. The drying temperature of 46° C. is referring to an infrared drying system, whereas with a conventional drying system the temperature is about 55° C.

The invention is directed to the development of medical X-ray materials. These materials contain emulsions based on silver bromide or silver bromoiodide grains, preferably containing at most 2.5 mole % of iodide ions. The silver halide grains of the photographic emulsions used according to the present invention may have a regular crystalline form such as a cubic or octahedral form or they may have a transition form. They may also have an irregular crystalline form such as a spherical form or a tabular form, or may otherwise have a composite crystal form comprising a mixture of said regular and irregular crystalline forms.

The silver halide grains may have a multilayered grain structure. According to a simple embodiment the grains may comprise a core and a shell, which may have different halide compositions and/or may have undergone different modifications such as the addition of dopes. Besides having a differently composed core and shell the silver halide grains may also comprise different phases inbetween.

Two or more types of silver halide emulsions that have been prepared differently can be mixed for forming a photographic emulsion for use in accordance with the present invention.

The average size of the silver halide grains may range from 0.1 to 1.00 μm, preferably from 0.3 to 0.7 μm.

The size distribution of the silver halide particles of the photographic emulsions to be used according to the present invention can be homodisperse or heterodisperse, a homodisperse size distribution being obtained when 95% of the grains have a size that does not deviate more than 30% from the average grain size.

Further illustrations of the invention will be given in the following examples.

EXAMPLE 1

1. Description of X-ray materials 1 and 2

Material 1

Emulsion Preparation

A tabular silver bromoiodide emulsion, containing 1 mole % of AgI and 99 mole % of AgBr, was precipitated using the double jet technique. The thus obtained tabular grain emulsion, containing 75 grams of gelatin pro mole of $AgNO_3$, had the following characteristics:

mean diameter of the circle with the same projective surface of the tabular grain: 1.12±0.23 μm (0.23 being the standard variation s).

mean thickness of the tabular grains : 0.23 μm.

aspect-ratio: 5.5.

percentage of total projective surface covered by the tabular grains: 98%.

Chemical sensitization

This emulsion was chemically sensitised in the presence of dye 1 (anhydro-5,5'-dichloro-3,3'-bis(n.sulfobutyl)-9-ethyloxacarbocyanine hydroxide), chloro auric acid, sodium thiosulphate and potassium thiocyanate.

Preparation of the Emulsion Coating Solution

The following ingredients were added per mole of silver halide:

| | |
|---|---|
| 4-hydroxy-6-methyl-1,3,3a,7-tetraazaindene | 0.29 grams |
| sorbitol | 9.10 grams |
| polyethylacrylate (MW-1000000) | 14.50 grams |
| 1,3 dihydroxybenzene | 3.05 grams |
| dextrane (MW = 10000) | 31.00 grams |

Composition of the Protective Layer

The coating weight is expressed in grams per square meter per side

| | |
|---|---|
| gelatin | 1.10 |
| polymethylmethacrylate (average particle diameter: 3.5 μm) | 0.023 |
| ammoniumperfluorocaprylate | 0.0075 |
| $C_{17}H_{15}$—CO—NH—($CH_2$—$CH_2$—O—)$_{17}$—H | 0.0188 |
| formaldehyde | 0.1 |

Coating

Both emulsion layer and protective layer were simultaneously coated on both sides of a polyethylene terephthalate film support of 175 μm thickness. The resulting photographic material contained 3.5 grams of $AgNO_3$ per $m^2$ per side.

Material 2

This material is the commercially available medical X-ray material CURIX ORTHO STA manufactured by Agfa-Gevaert N.V., Belgium, which is a double coated film suitable for use with green light emitting X-ray sensitive screens.

2-Exposure, sensitometry and densitometry

Samples of the photographic materials 1 and 2 were illuminated using a continuous wedge with green light of 540 nm during 0.02 seconds and were processed under the circumstances described further; material 1 being processed in accordance with the present invention in 38 sec. whereas material 2 being processed for comparison purposes in the known 90 sec. commercial processing cycle. The density as a function of the light dose was measured and therefrom were determined: fog level (with an accuracy of 0.001 density point), the relative speed S at a density of 1 above fog (reference was set to a speed of 100), maximum density DMAX, the gradient AG between 0.25 above fog and 2.0 above fog, the gradient AGTOE between 0.1 and 1.0 above fog and the gradient AGBACK between 1.0 and 2.5 above fog.

3.Processing conditions 3.1. 90 seconds reference processing:

processing machine: CURIX 402 (Agfa-Gevaert trademarked name) with the following time (in seconds) and temperature (in 0° C.) characteristics:

| | |
|---|---|
| loading | 3.4 sec. |
| developing | 23.4 sec./ 35° C. in Agfa-Gevaerts commercial G138 developer |
| cross-over | 3.8 sec. |
| fixing | 15.7 sec./ 35° C. in Agfa-Gevaerts commercial G334 fixer |
| cross-over | 3.8 sec. |
| rinsing | 15.7 sec./ 20° C. |
| cross-over + drying | 32.2 sec. |
| total time | 98.0 sec. |

3.2. Conditions for the 38 seconds processing as applied in accordance with this invention processing machine: CURIX HT530 (Agfa-Gevaert trademarked name) with the following time (in seconds) and temperature (in ° C.) characteristics:

| | | |
|---|---|---|
| loading | 0.2 sec. | |
| developing | 9.3 sec. | 35° C. in developer I described below |
| cross-over | 1.4 sec. | |
| rinsing | 0.9 sec. | |
| cross-over | 1.5 sec. | |
| fixing | 6.6 sec. | 35° C. in fixer I described below |
| cross-over | 2.0 sec. | |
| rinsing | 4.4 sec. | 20° C. |
| cross-over | 4.6 sec. | |
| drying | 6.7 sec. | |
| total | 37.6 sec. | |

Composition of Developer I:

concentrated part:

| | |
|---|---|
| water | 200 ml |
| potassium bromide | 12 grams |
| potassium sulphite (65% solution) | 249 grams |
| ethylenediaminetetraacetic acid, sodium salt, trihydrate | 9.6 grams |

-continued

| | |
|---|---|
| hydroquinone | 106 grams |
| 5-methylbenzotriazole | 0.076 grams |
| 1-phenyl-5-mercaptotetrazole | 0.040 grams |
| sodiumtetraborate (decahydrate) | 70 grams |
| potassium carbonate | 38 grams |
| potassium hydroxide | 49 grams |
| diethylene glycol | 11 grams |
| potassium iodide: in variable amounts(see Table I: amounts after dilution) | |
| 4-hydroxymethyl-4methyl-1phenyl-3-pyrazolidinone: in variable amounts(see Table I: amounts after dilution) | |
| Water to make 1 liter | |

pH adjusted to 11.15 at 25° C. with potassium hydroxide.

For initiation of the processing one part of the concentrated developer was mixed with 3 parts of water.

No starter was added.

The pH of this mixture was 10.30 at 25° C.

Composition of Fixer I:

| concentrated part: | |
|---|---|
| ammonium thiosulfate (78% solution) | 661 grams |
| sodium sulphite | 54 grams |
| boric acid | 25 grams |
| sodium acetate-trihydrate | 70 grams |
| acetic acid | 40 grams |
| water to make 1 liter | |

pH adjusted with acetic acid to 5.30 at 25° C.

To make this fixer ready for use one part of this concentrated part was mixed with 4 parts of water. A pH of 5.25 was measured at 25° C.

4. Results

The effect of KI in a hydroquinone/4-hydroxymethyl-4-methyl-1-phenyl-3-pyrazolidinone (HMMPHEN) developing bath for 38 seconds processing on the sensitometric characteristics of material 1 is given in Table 1 as compared with conventional 90 sec. processing of material 2.

(ref.)=standard 90 s processing of material 2.

(comp.)=comparative 38 s processing of material 1;

(inv.)=38 s processing of material 1 in accordance with the invention.

TABLE 1

| MAT. | KI (g/l) | HMMPHEN (g/l) | FOG | S | DMAX | AG | AGTOE | AGBACK |
|---|---|---|---|---|---|---|---|---|
| 2 | — | — | 0.035 | 100 | 3.63 | 3.40 | 1.90 | 4.16 (ref.) |
| 1 | 0 | 3 | 0.024 | 73 | 3.58 | 3.55 | 1.97 | 4.58(comp.) |
| 1 | 0.022 | 3 | 0.036 | 100 | 3.57 | 3.41 | 1.97 | 4.21 (inv.) |
| 1 | 0 | 5 | 0.030 | 87 | 3.59 | 3.51 | 1.93 | 4.54(comp.) |
| 1 | 0.022 | 5 | 0.053 | 120 | 3.58 | 3.28 | 1.87 | 4.15 (inv.) |

The results in Table 1 clearly show that in the presence of potassium iodide in the hardener free developer a higher sensitivity is obtained after 38 s processing so that even with less than 3.5 g of the expensive HMMPHEN the desired sensitometric profile (see reference) is obtained. Combined with HMMPHEN still higher sensitivities may be achieved.

EXAMPLE II

Samples of the commercial CURIX ORTHO STA were exposed as described in example 1 and processed on the one hand in a commercial 90 sec. processing cycle as referred to in example 1 and on the other hand in a 38 seconds processing with hardener containing developer.

The composition of the developing and fixing solutions that were applied for the 38 sec. processing are as follows:

Composition of developer II (containing a hardener): concentrated part A:

| | |
|---|---|
| water | 200 ml |
| potassium bromide | 12 grams |
| potassium sulphite (65% solution) | 249 grams |
| ethylenediaminetetraacetic acid, sodium salt, trihydrate | 9.6 grams |
| hydroquinone | 106 grams |
| sodiumtetraborate, decahydrate | 70 grams |
| potassium carbonate | 38 grams |
| potassium hydroxide | 77 grams |
| diethylene glycol | 56 grams |
| 1-phenyl-5-mercaptotetrazole | 0.10 grams |
| 5-methylbenzotriazole | 0.076 grams |
| 4-hydroxymethyl-4methyl-1phenyl-3-pyrazolidinone: in variable amounts(see Table 2: amounts after dilution) | |
| potassium iodide: in variable amounts(see Table 2: amounts after dilution) | |
| water to make 1 liter | |

pH adjusted to 11.80 at 25 C. with potassium hydroxide.

concentrated part B:

| | |
|---|---|
| acetic acid | 30.1 grams |
| 1-phenyl-3-pyrazolidinone | 10.0 grams |
| 5-nitro-indazole | 1.15 grams |
| diethylene glycol to make 100 ml | |

concentrated part C:

| | |
|---|---|
| glutaric dialdehyde (50% solution) | 17.8 grams |
| potassiummetabisulphite | 26.0 grams |
| water to make 100 ml | |

For initiation of the processing the three parts were mixed in the following ratio : 250 ml of part A, 700 ml of water, 25 ml of part B and 25 ml of part C. No starter solution was added. A pH of 10.40 at 25° C. was measured.

Composition fixer II (containing a hardener) concentrated part A:

| | |
|---|---|
| ammoniumthiosulphate (78% solution) | 661 grams |
| sodium sulphite | 54 grams |
| boric acid | 25 grams |
| sodium acetate trihydrate | 70 grams |
| acetic acid | 40 grams |
| water to make 1 liter | |

pH adjusted with acetic acid to 5.30 at 25° C.

concentrated part B:

| | |
|---|---|
| water | 150 ml |
| acetic acid | 10 grams |
| sulphuric acid | 13 grams |

-continued

| | |
|---|---|
| aluminium sulphate (34% solution) | 27 grams |
| water to make 250 ml | |

The fixer ready for use was then made by mixing concentrated part A, water and concentrated part B in the following ratio: respectively 250 ml, 687.5 ml and 62.5 ml. A pH of this mixture of 4.25 at 25° C. was measured.

The sensitometric results obtained are set forth in Table 2.

TABLE 2

| MAT. | KI (g/l) | HMMPHEN (g/l) | FOG | S | DMAX | AG | AGTOE | AGBACK |
|---|---|---|---|---|---|---|---|---|
| 2 | — | — | 0.020 | 100 | 3.59 | 3.25 | 1.97 | 3.77 (ref.) |
| 2 | 0 | 0 | 0.027 | 53 | 3.63 | 3.19 | 1.90 | 3.89 (comp.) |
| 2 | 0.050 | 0 | 0.030 | 80 | 3.62 | 3.21 | 1.98 | 3.78 (inv.) |
| 2 | 0 | 4.25 | 0.026 | 70 | 3.66 | 3.20 | 1.89 | 3.96 (comp.) |
| 2 | 0.050 | 4.25 | 0.031 | 93 | 3.65 | 3.17 | 1.93 | 3.75 (inv.) |

The results in table 2 clearly show that in the presence of potassium iodide in the hardener containing developer a higher sensitivity is obtained after 38 s processing. In the presence of HMMPHEN the same desired sensitometric profile can be obtained as in the 90 s reference cycle. To obtain this reference sensitometric profile with the expensive HMMPHEN alone even higher concentrations than 4.25 grams per liter are necessary.

We claim:

1. Method of processing an exposed silver bromide or silver bromoiodide X-ray material which comprises development with an aqueous alkaline photographic developing solution having a pH in the range of 9 to 12, comprising a dihydroxybenzene developing agent, 4-hydroxymethyl-4-methyl-1-phenyl-3-pyrazolidinone as an auxiliary developing agent and at least one organic antifoggant characterized in that the developing solution further contains an iodide ion releasing compound to provide at least $4.10^{-5}$ equivalents of ions per liter.

2. Method as claimed in claim 1 wherein said dihydroxybenzene developing agent is hydroquinone.

3. Method as claimed in claim 1 wherein said iodide ion providing compound is potassium iodide.

4. Method as claimed in claim 1 wherein said organic antifoggant(s) is(are) 5-methylbenzotriazole and/or 1-phenyl-5-mercaptotetrazole.

5. Method as claimed claim 1 wherein the amount of 4-hydroxymethyl-4-methyl-1-phenyl-3-pyrazolidinone is from 1.0 to 3.5 grams per liter of said developing solution.

6. Method as claimed in claim 3 wherein said iodide ions providing compound is potassium iodide and is present in an amount from 0.010 to 0.1 grams per liter of said developing solution.

7. Method as claimed in claim 2 wherein the amount of hydroquinone is from 20 to 40 grams per liter of said developing solution.

8. Method according to claim 1 wherein said developing solution essentially has the following composition: from 20 to 40 grams per liter of hydroquinone, from 1.0 to 3.5 grams per liter of 4-hydroxymethyl-4-methyl-1-phenyl-3-pyrazolidinone, from 0.010 to 0.1 gram per liter of potassium iodide, from 0.01 to 0.1 gram per liter of 5-methyl-benzotriazole, from 0 to 0.050 gram per liter of 1-phenyl-5-mercaptotetrazole and from 20 to 100 grams per liter of potassium sulphite.

9. Method according to claim 1 wherein the total processing time is 60 seconds or less.

* * * * *